US009975714B2

(12) United States Patent
Hirata et al.

(10) Patent No.: US 9,975,714 B2
(45) Date of Patent: May 22, 2018

(54) CONVEYOR AND TRAY UNIT

(71) Applicant: BROTHER KOGYO KABUSHIKI KAISHA, Nagoya-shi, Aichi-ken (JP)

(72) Inventors: Kenichi Hirata, Nagoya (JP); Masayuki Okumura, Nagoya (JP); Tadanobu Chikamoto, Nagoya (JP); Hideki Yamamoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/437,111

(22) Filed: Feb. 20, 2017

(65) Prior Publication Data

US 2017/0283199 A1 Oct. 5, 2017

(30) Foreign Application Priority Data

Mar. 31, 2016 (JP) ..... 2016-069873

(51) Int. Cl.
*B65H 39/10* (2006.01)
*B65H 5/36* (2006.01)
(Continued)

(52) U.S. Cl.
CPC ..... *B65H 5/36* (2013.01); *B65H 29/12* (2013.01); *B65H 31/02* (2013.01); *B65H 31/30* (2013.01);
(Continued)

(58) Field of Classification Search
CPC ..... B65H 39/11; B65H 2301/166; B65H 2405/11151; B65H 2405/1111;
(Continued)

(56) References Cited

U.S. PATENT DOCUMENTS 5,141,215 A * 8/1992 Ishiguro ..... B65H 39/11 270/58.14
6,112,047 A * 8/2000 Kato ..... B65H 29/00 271/279
(Continued)

FOREIGN PATENT DOCUMENTS

JP 2007210792 A * 8/2007 ..... B65H 31/20
JP 4204934 B2 1/2009
JP 2016216250 A * 12/2016 ..... B65H 31/24

*Primary Examiner* — Howard J Sanders
(74) *Attorney, Agent, or Firm* — Merchant & Gould P.C.

(57) ABSTRACT

A conveyor, including: receiving trays; a conveyance mechanism; and a support supporting the trays, wherein at least one tray except a lowermost tray is supported so as to be selectively positioned at one of a receiving position and an upper position, wherein at least one lower tray except an uppermost tray includes a protruding portion attached to a tray body so as to be selectively positioned at one of a protruding position and a retracted position, and wherein the conveyor includes a force transmitting mechanism for effectuating at least one of (a) a retracting movement of the protruding portion of one of the at least one lower tray from the protruding position to the retracted position caused by an upward movement of an adjacent upper tray disposed just above and immediately adjacent to the one of the at least one lower tray from the receiving position to the upper position.

14 Claims, 10 Drawing Sheets

(51) Int. Cl.

| | |
|---|---|
| ***B65H 29/12*** | (2006.01) |
| ***B65H 31/02*** | (2006.01) |
| *B65H 31/30* | (2006.01) |
| *B65H 39/11* | (2006.01) |

(52) U.S. Cl.
CPC ..... *B65H 39/11* (2013.01); *B65H 2405/1111* (2013.01); *B65H 2405/332* (2013.01); *B65H 2405/36* (2013.01); *B65H 2801/27* (2013.01)

(58) Field of Classification Search
CPC ..... B65H 2405/332; B65H 2405/35; B65H 2405/353; B65H 31/02; B65H 31/04; B65H 31/30
See application file for complete search history.

(56) References Cited

U.S. PATENT DOCUMENTS

| | | | | |
|---|---|---|---|---|
| 2014/0339764 | A1* | 11/2014 | Suzuki ..... | B65H 31/24 271/302 |
| 2016/0154358 | A1* | 6/2016 | Hashimoto ..... | B65H 31/20 271/213 |

* cited by examiner

CONVEYOR AND TRAY UNIT

CROSS REFERENCE TO RELATED APPLICATION

The present application claims priority from Japanese Patent Application No. 2016-069873, which was filed on Mar. 31, 2016, the disclosure of which is herein incorporated by reference in its entirety.

BACKGROUND

Technical Field

The following disclosure relates to a conveyor having a plurality of receiving trays arranged in the vertical direction and a tray unit included in the conveyor.

Description of Related Art

Conveyors having a plurality of receiving trays arranged in the vertical direction are known. For instance, there is known a sheet discharge apparatus (conveyor) having four discharge trays (receiving trays) arranged in the vertical direction. Each of the four discharge trays includes a tray body and a stopper member (protruding portion) that protrudes from an upper surface of of the tray body. The stopper member is pivotable with respect to the tray body and is configured to be selectively positioned at one of a stop position (protruding position) and a non-protruding position (retracted position) at which the stopper member does not protrude from the upper surface of the tray body. With this configuration, when a sheet on the tray body is removed therefrom, the stopper member moves from the stop position to the non-protruding position, so that the sheet is prevented from being caught on the stopper member.

SUMMARY

In the known apparatus, however, the receiving trays are fixed to the apparatus. In this configuration, a space between adjacent two of the receiving trays decreases with a decrease in the size of the apparatus, and it becomes difficult to remove a medium from each receiving tray except an uppermost one of the receiving trays, namely, from each lower tray. In particular, it is difficult to remove, from the lower tray, a medium having a smaller dimension in a conveyance direction in which the medium is conveyed.

An aspect of the disclosure relates to a conveyor and a tray unit that enables a medium to be easily removed from each lower tray.

A conveyor according to a first aspect of the disclosure provides a conveyor, including: a plurality of receiving trays arranged in a vertical direction and each having a receiving surface by which a medium is received; a conveyance mechanism configured to convey the medium such that medium is selectively received by one of the receiving surfaces of the receiving trays; and a support supporting the receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a tray body that forms the receiving surface and a protruding portion attached to the tray body so as to be selectively positioned at one of a protruding position at which the protruding portion protrudes from the receiving surface and a retracted position at which a protrusion amount of the protruding portion from the receiving surface is smaller than that when the protruding portion is positioned at the protruding position, and wherein the conveyor further comprises a force transmitting mechanism for effectuating at least one of (a) a retracting movement of the protruding portion of one of the at least one lower tray caused by an upward movement of an adjacent upper tray which is disposed just above and immediately adjacent to the one of the at least one lower tray and (b) the upward movement caused by the retracting movement, the retracting movement being a movement in which the protruding portion of the one of the at least one lower tray moves from the protruding position to the retracted position, the upward movement being a movement in which the adjacent upper tray moves from the receiving position to the upper position.

A tray unit according to the first aspect of the disclosure provides a tray unit for a conveyor, the conveyor including: a plurality of receiving trays arranged in a vertical direction and each having a receiving surface by which a medium is received; a conveyance mechanism configured to convey the medium such that medium is selectively received by one of the receiving surfaces of the receiving trays; and a support supporting the receiving trays, the tray unit comprising the plurality of receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a tray body that forms the receiving surface and a protruding portion attached to the tray body so as to be selectively positioned at one of a protruding position at which the protruding portion protrudes from the receiving surface and a retracted position at which a protrusion amount of the protruding portion from the receiving surface is smaller than that when the protruding portion is positioned at the protruding position, and wherein the tray unit further comprises a force transmitting mechanism for effectuating at least one of (a) a retracting movement of the protruding portion of one of the at least one lower tray caused by an upward movement of an adjacent upper tray which is disposed just above and immediately adjacent to the one of the at least one lower tray and (b) the upward movement caused by the retracting movement, the retracting movement being a movement in which the protruding portion of the one of the at least one lower tray moves from the protruding position to the retracted position, the upward movement being a movement in which the adjacent upper tray moves from the receiving position to the upper position.

A conveyor according to a second aspect of the disclosure provides a conveyor, including: a plurality of receiving trays arranged in a vertical direction and each having a receiving surface by which a medium is received; a conveyance mechanism configured to convey the medium such that the medium is selectively received by one of the receiving surfaces of the receiving trays; and a support supporting the receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a proximal portion which defines a part of the receiving surface and a distal portion which is located downstream of the proximal portion in the conveyance direction and which defines the rest of the receiving surface, wherein the distal portion includes a protruding portion protruding from the rest of the receiving surface and is pivotally attached to the proximal portion so as to be selectively positioned at one of a first position and a second position at which a protrusion amount of the protruding portion from a plane along the part of the receiving surface of the proximal portion is smaller than that when the distal portion is positioned at the first position, and wherein the conveyor further comprises a force transmitting mechanism for effectuating at least one of (e) a distal-portion movement of the distal portion of one of the at least one lower tray caused by an upward movement of an adjacent upper tray which is disposed just above and immediately adjacent to the one of the at least one lower tray and (f) the upward movement caused by the distal-portion movement, the distal-portion movement being a movement in which the distal portion of the one of the at least one lower tray moves from the first position to the second position, the upward movement being a movement in which the adjacent upper tray moves from the receiving position to the upper position.

A tray unit according to the second aspect of the disclosure provides a tray unit for a conveyor, the conveyor including: a plurality of receiving trays arranged in a vertical direction and each having a receiving surface by which a medium is received; a conveyance mechanism configured to convey the medium such that the medium is selectively received by one of the receiving surfaces of the receiving trays; and a support supporting the receiving trays, the tray unit comprising the plurality of receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a proximal portion which defines a part of the receiving surface and a distal portion which is located downstream of the proximal portion in the conveyance direction and which defines the rest of the receiving surface, wherein the distal portion includes a protruding portion protruding from the rest of the receiving surface and is pivotally attached to the proximal portion so as to be selectively positioned at one of a first position and a second position at which a protrusion amount of the protruding portion from a plane along the part of the receiving surface of the proximal portion is smaller than that when the distal portion is positioned at the first position, and wherein the tray unit further comprises a force transmitting mechanism for effectuating at least one of (e) a distal-portion movement of the distal portion of one of the at least one lower tray caused by an upward movement of an adjacent upper tray which is disposed just above and immediately adjacent to the one of the at least one lower tray and (f) the upward movement caused by the distal-portion movement, the distal-portion movement being a movement in which the distal portion of the one of the at least one lower tray moves from the first position to the second position, the upward movement being a movement in which the adjacent upper tray moves from the receiving position to the upper position.

In the above-indicated first and second aspects of the disclosure, the lowermost one of the receiving trays may also be supported by the support so as to be selectively positioned at one of the receiving position and the upper position.

In the above-indicated first aspect of the disclosure, the uppermost one of the receiving trays may also include the protruding portion attached to the tray body so as to be selectively positioned at one of the protruding position and the retracted position.

In the above-indicated second aspect of the disclosure, the uppermost one of the receiving trays may also include the proximal portion which defines a part of the receiving surface and the distal portion which defines the rest of the receiving surface.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

Figure 1:
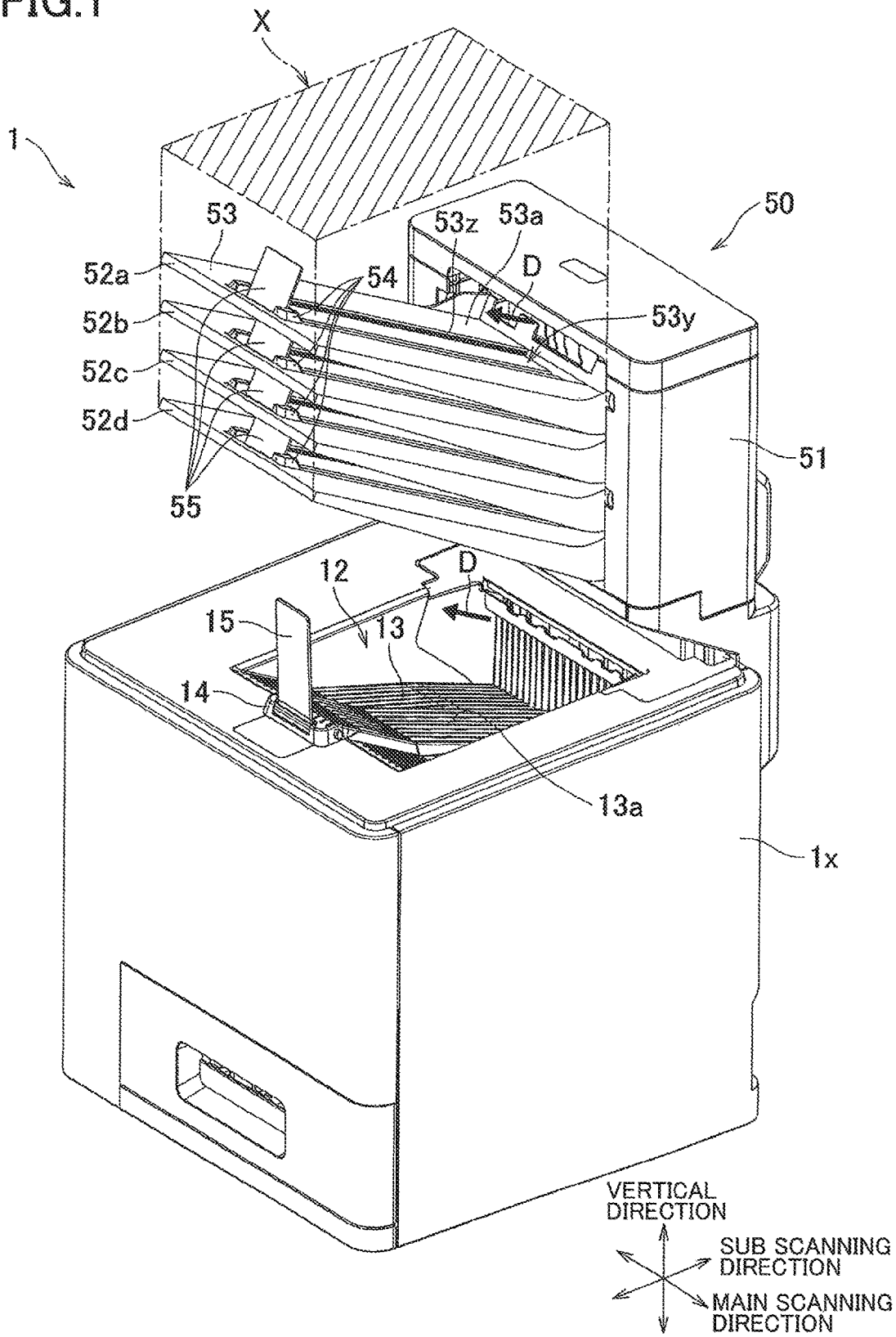
FIG. 1 is a perspective view of an ink-jet printer according to a first embodiment.
Figure 2:
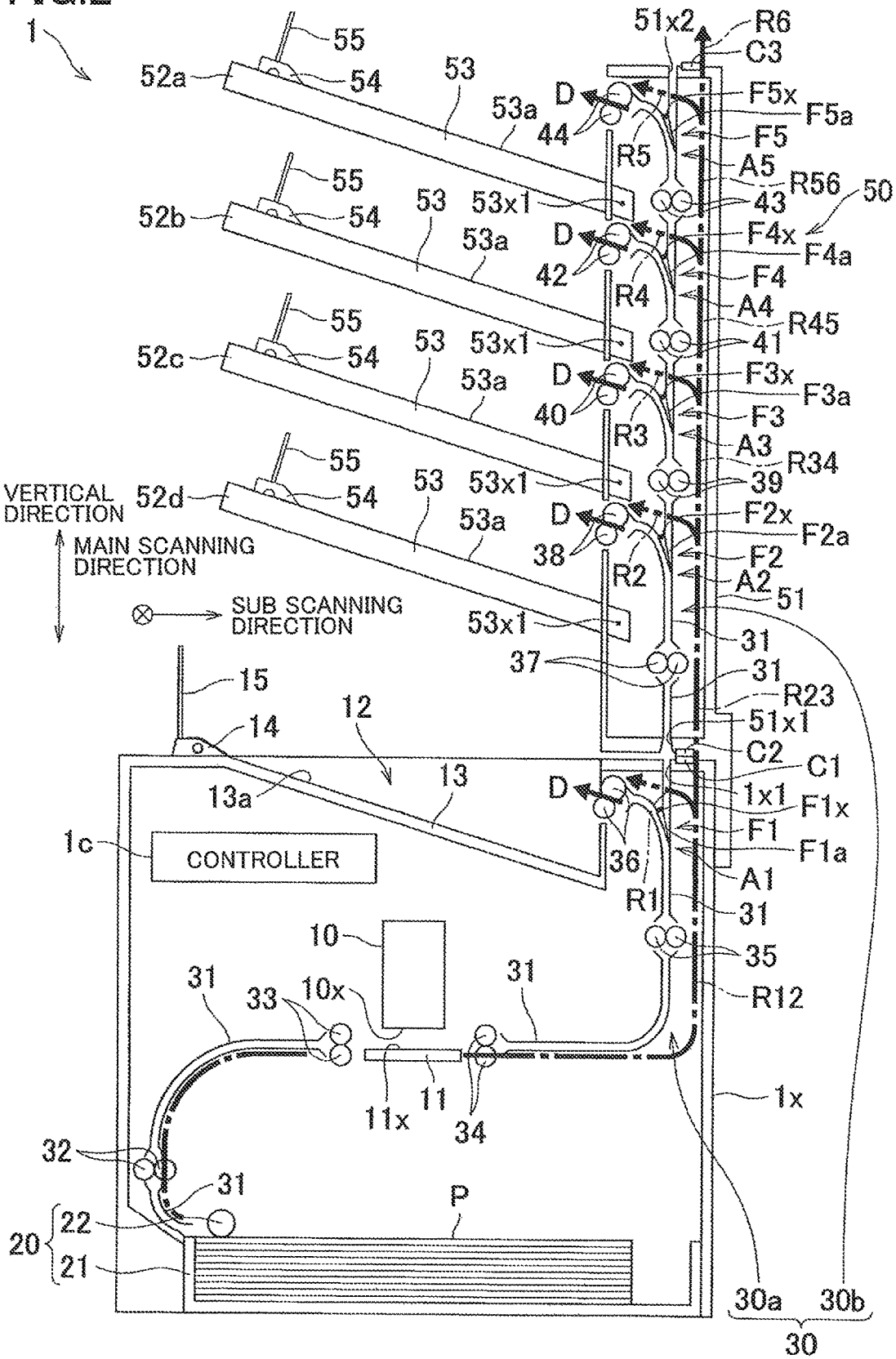
FIG. 2 is a schematic view of the ink-jet printer according to the first embodiment.

There will be described an ink-jet printer (hereinafter simply referred to as "printer") 1 according to a first embodiment. As shown in FIGS. 1 and 2, the printer 1 includes a housing 1*x* having a generally rectangular parallelepiped shape and a tray unit 50 removably installed on the housing 1*x*. The tray unit 50 is disposed on an upper portion of the housing 1*x* such that an opening 1*x*1 formed in an upper surface of the housing 1*x* and an opening 51*x*1 formed in a lower surface of a support 51 are opposed to each other. Another tray unit may be additionally installed on an upper portion of the tray unit 50.

A receiving tray 12 is provided at the upper portion of the housing 1*x*.

The receiving tray 12 includes: a tray body 13 defined by an upper wall of the housing 1*x*; a base 14 removably attached to the tray body 13; and a stopper 15 attached to the base 14 so as to be pivotable about an axis extending in a main scanning direction. The tray body 13 has a receiving surface 13*a* for receiving a sheet P.

The tray unit 50 includes: four receiving trays 52*a*-52*d* arranged in the vertical direction; and the support 51 shaped like a housing and supporting the receiving trays 52*a*-52*d* such that each of the receiving trays 52*a*-52*d* is pivotable about an axis 53*x*1 extending in the main scanning direction. The receiving tray 52*a* is an uppermost tray disposed at the highest position among the four receiving trays 52*a*-52*d*. The receiving trays 52*b*-52*d* are lower trays. The receiving tray 52*d* is a lowermost tray disposed at the lowest position among the four receiving trays 52*b*-52*d*.

Each of the receiving trays 52*a*-52*d* includes: a tray body 53 shaped like a plate and having a groove 53*y* formed in its upper surface; a base 54 detachably attached to the tray body 53 in the groove 53*y* so as to be movable in mutually opposite directions parallel to a conveyance direction D in which the sheet P is discharged onto the receiving tray; and a stopper 55 attached to the base 54 so as to be pivotable about an axis 55*x*1 (FIGS. 4 and 5) extending in the main scanning direction. The tray body 53 has a receiving surface 53*a* for receiving the sheet P.

Projective areas X, which are formed by projecting the receiving surfaces 13*a*, 53*a* of the receiving trays 12, 52*a*-52*d* in the vertical direction onto an imaginary plane orthogonal to the vertical direction, overlap each other. In other words, at least a part of a projective area formed by projecting, in the vertical direction, the receiving surface of each of the at least one lower tray on an imaginary plane orthogonal to the vertical direction overlaps a projective area formed by projecting, in the vertical direction, the receiving surface of any one of the receiving trays disposed above said each of the at least one lower tray.

In the tray body 53, a multiplicity of recesses 53*z* are formed in side surfaces which partially define the groove 53*y* and which extend in the conveyance direction D. The recesses 53*z* are arranged in the conveyance direction D. A pair of protrusions (not shown) are provided on outer side surfaces of the base 54 which are perpendicular to the main scanning direction. The protrusions of the base 54 are configured to be fitted in any one of pairs of recess 53*z* of the tray body 53 which are opposed to each other in the main scanning direction. When the pair of protrusions are fitted in the pair of recesses 53*z*, the base 54 is positioned with respect to the tray body 53.

The support 51 covers an upstream end portion of each of the receiving trays 52*a*-52*d* in the conveyance direction D to prevent or hinder removal of the sheet P from the receiving surface 53*a* in the main scanning direction. That is, the support 51 is one example of a hindering member.

The housing 1*x* houses an ink-jet head (hereinafter simply referred to as "head") 10, a platen 11, a sheet supply mechanism 20, a conveyance mechanism 30*a*, and a controller 1*c*. A conveyance mechanism 30*b* is provided in the support 51.

The head 10 has a generally rectangular parallelepiped shape that is long in the main scanning direction. That is, the printer 1 is an ink-jet printer of a line type. The head 10 includes: a flow-passage unit in which are formed ink passages including pressure chambers; and actuators each configured to give a pressure to ink in a corresponding one of the pressure chambers in the flow-passage unit. A lower surface of the head 10, i.e., a lower surface of the flow-passage unit, serves an ejection surface 10*x* in which are formed a plurality of ejection openings for ejecting ink. The ink is supplied from a cartridge (not shown) to the ink passages of the flow-passage unit.

The platen 11 is disposed below the head 10. The platen 11 is a flat plate and has a support surface 11*x* for supporting the sheet P. The support surface 11*x* of the platen 11 is opposed to the ejection surface 10*x* of the head 10 in the vertical direction with a space interposed therebetween.

Figure 3:
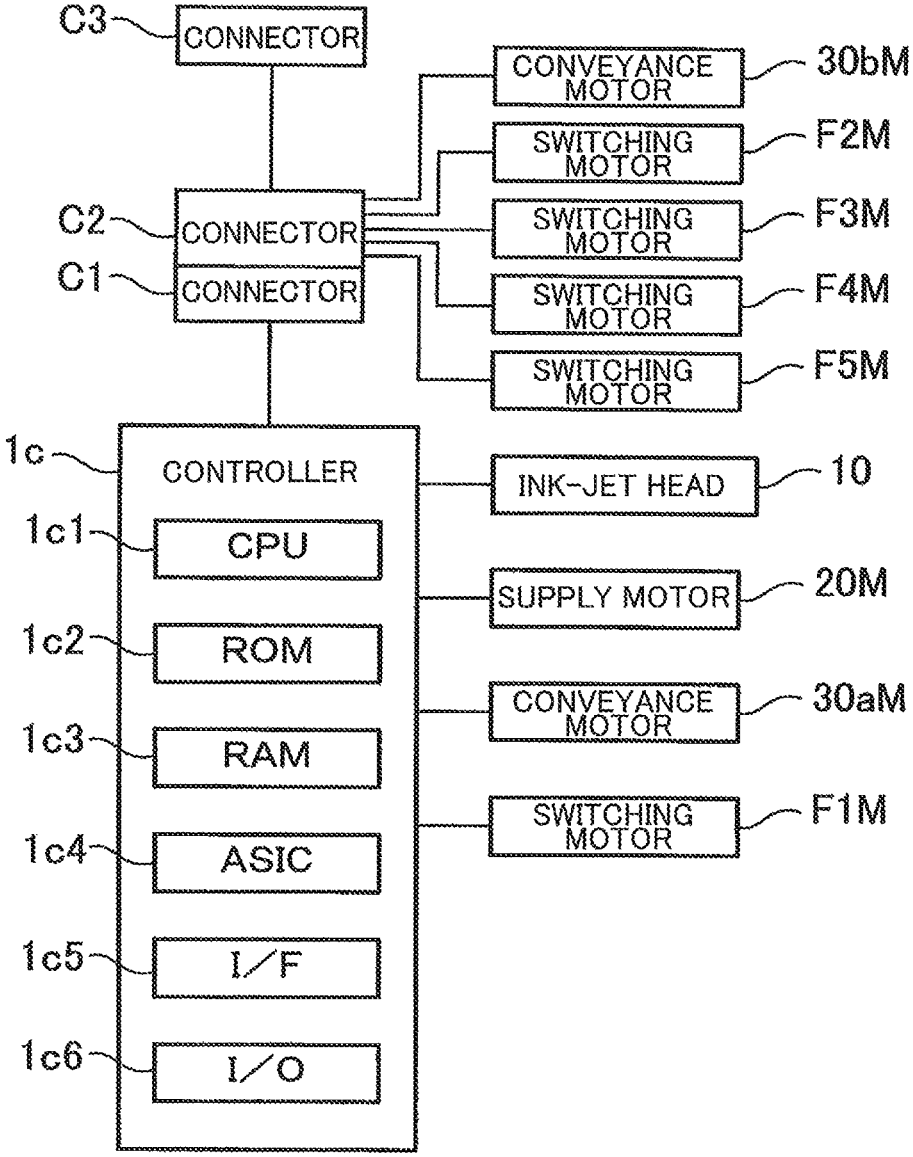
FIG. 3 is a block diagram showing an electric configuration of the ink-jet printer according to the first embodiment.

The sheet sheet supply mechanism 20 includes a sheet tray 21 removably installed on the housing 1*x* and capable of storing a plurality of sheets P; and a sheet supply roller 22 attached to the sheet tray 21. Under control of the controller 1*c*, the sheet supply roller 22 rotates by being driven by a sheet supply motor 20M (FIG. 3). In a state in which the sheet supply roller 22 is in contact with an uppermost one of the sheets P stacked on the sheet tray 21, the sheet supply roller 22 rotates to supply the uppermost sheet P.

A conveyance mechanism 30 is constituted by a conveyance mechanism 30*a* and the conveyance mechanism 30*b*. The conveyance mechanism 30 is configured to convey the sheet P such that the sheet P supplied from the sheet sheet supply mechanism 20 passes the space between the ejection surface 10*x* and the support surface 11*x* and is consequently received by a selected one of the receiving trays 12, 52*a*-52*d* and receiving trays of another tray unit disposed on the upper portion of the tray unit 50. The conveyance mechanism 30 forms paths R1-R6.

The path R1 is a path through which the sheet P is conveyed toward the receiving tray 12. The path R2 is a path through which the sheet P is conveyed toward the receiving tray 52*d*. The path R3 is a path through which the sheet P is conveyed toward the receiving tray 52*c*. The path R4 is a path through which the sheet P is conveyed toward the receiving tray 52*b*. The path R5 is a path through which the sheet P is conveyed toward the receiving tray 52*a*. The path R6 is a path through which the sheet P is conveyed toward a receiving tray of another tray unit through an opening 51*x*2 formed in an upper surface of the support 51.

At one end of a common path R12 common to the paths R1, R2, i.e., at a branch position A1, the paths R1, R2 branch off from the common path R12. At one end of a common path R23 common to the paths R2, R3, i.e., at a branch position A2, the paths R2, R3 branch off from the common path R23. At one end of a common path R34 common to the paths R3, R4, i.e., at a branch position A3, the paths R3, R4 branch off from the common path R34. At one end of a common path R45 common to the paths R4, R5, i.e., at a branch position A4, the paths R4, R5 branch off from the common path R45. At one end of a common path R56 common to the paths R5, R6, i.e., at a branch position A5, the paths R5, R6 branch off from the common path R56.

The conveyance mechanism 30*a* includes a guide 31 and roller pairs 32-36. The conveyance mechanism 30*b* includes the guide 31 and roller pairs 37-44.

The guide 31 is disposed so as to be opposed to front and back surfaces of the sheet P conveyed along the paths R1-R6.

The roller pairs 32-36 are disposed along the path R1. The roller pairs 37, 38 are disposed along the path R2 that branches off from the common path R12. The roller pairs 39, 40 are disposed along the path R3 that branches off from the common path R23. The roller pairs 41, 42 are disposed along the path R4 that branches off from the common path R34. The roller pairs 43, 44 are disposed along the path R5 that branches off from the common path R45.

Under the control of the controller 1*c*, the roller pairs 32-36 rotate by being driven by a conveyance motor 30*a*M (FIG. 3) and the roller pairs 37-44 rotate by being driven by a conveyance motor 30*b*M (FIG. 3). The rollers of each of the roller pairs 32-44 rotate with the sheet P nipped therebetween, thereby applying a conveyance force to the sheet P.

Switchers F1-F5 are provided at the respective branch positions A1-A5 to switch a destination of the sheet P at the respective branch positions A1-A5. The switchers F1-F5 respectively have movable members F1*a*-F5*a* which are pivotable about respective shafts F1*x*-F5*x* each extending in the main scanning direction.

Under the control of the controller 1*c*, the movable member F1*a* is driven by a switching motor F1M (FIG. 3) and pivots between: a position (FIG. 1) at which the movable member F1*a* guides the sheet P from the common path R12 to the path R1; and a position at which the movable member F1*a* guides the sheet P from the common path R12 to the path R2. Under the control of the controller 1*c*, the movable member F2*a* is driven by a switching motor F2M (FIG. 3) and pivots between: a position (FIG. 1) at which the movable member F2*a* guides the sheet P from the common path R23 to the path R2; and a position at which the movable member F2*a* guides the sheet P from the common path R23 to the path R3. Under the control of the controller 1*c*, the movable member F3*a* is driven by a switching motor F3M (FIG. 3) and pivots between: a position (FIG. 1) at which the movable member F3*a* guides the sheet P from the common path R34 to the path R3; and a position at which the movable member F3*a* guides the sheet P from the common path R34 to the path R4. Under the control of the controller 1*c*, the movable member F4*a* is driven by a switching motor F4M (FIG. 3) and pivots between: a position (FIG. 1) at which the movable member F4*a* guides the sheet P from the common path R45 to the path R4; and a position at which the movable member F4*a* guides the sheet P from the common path R45 to the path R5. Under the control of the controller 1*c*, the movable member F5*a* is driven by a switching motor F5M (FIG. 3) and pivots between: a position (FIG. 1) at which the movable member F5*a* guides the sheet P from the common path R56 to the path R5; and a position at which the movable member F5*a* guides the sheet P from the common path R56 to the path R6.

As shown in FIG. 3, the controller 1*c* includes a central processing unit (CPU) 1*c*1 as a computing device, a read only memory (ROM) 1*c*2, a random access memory (RAM) 1*c*3, an application specific integrated circuit (ASIC) 1*c*4, an interface (I/F) 1*c*5, and an input/output port (I/O) 1*c*6. The ROM 1*c*2 stores fixed data such as programs executed by the CPU 1*c*1. The RAM 1*c*3 temporarily stores data required for the CPU1*c*1 to execute the programs. The ASIC 1*c*4 executes rewriting and sorting of image data such as signal processing and image processing. The I/F 1*c*5 transmits and receives data to and from an external device such as a PC connected to the printer 1. The I/O 1*c*6 transmits and receives signals to and from various sensors. The CPU 1*c*1 is electrically connected to the devices of the controller 1*c* other than the CPU 1*c*1 and executes control based on data received from the devices.

The controller 1*c* is electrically connected to a connector C1 provided on the upper surface of the housing 1*x*. When the tray unit 50 is installed on the housing 1*x*, the connector C1 is brought into contact with and electrically connected to a connector C2 provided on the lower surface of the support 51. The connector C2 is electrically connected to the conveyance motor 30*b*M and the switching motors F2M-F5M of the tray unit 50. Thus, signal transmission and reception are performable between: the controller 1*c*; and the conveyance motor 30*b*M and the switching motors F2M-F5M of the tray unit 50.

When another tray unit is installed on the upper portion of the tray unit 50, a connector C3 provided on the upper surface of the support 51 of the tray unit 50 is brought into contact with and electrically connected to another connector provided on a lower surface of a support of another tray unit. The connector of another tray is electrically connected to a conveyance motor and switching motors of another tray unit. Thus, signal transmission and reception are performable between: the controller 1*c*; and the conveyance motor and the switching motors of another tray unit.

Under the control of the controller 1*c*, the actuators of the head 10 are driven and the ink is selectively ejected from the ejection openings formed in the ejection surface 10*x* when the sheet P conveyed by the conveyance mechanism 30 passes through the space between the ejection surface 10*x* and the support surface 11*x*. The ejected ink is attached to the sheet P, so that an image is formed on the sheet P, namely, image recording is performed on the sheet P. The sheet P which has been subjected to the image recording is further conveyed by the conveyance mechanism 30 and is finally received by a selected one of the receiving trays 12, 52*a*-52*d*.

When the sheet P is received by one of the receiving trays 12, 52*a*-52*d*, the sheet P is conveyed in the conveyance direction D, and its leading end comes into contact with the stopper 15, 55, so that the sheet P drops onto a corresponding one of the receiving surfaces 13*a*, 53*a* of the receiving trays 12, 52*a*-52*d*.

Figure 4:
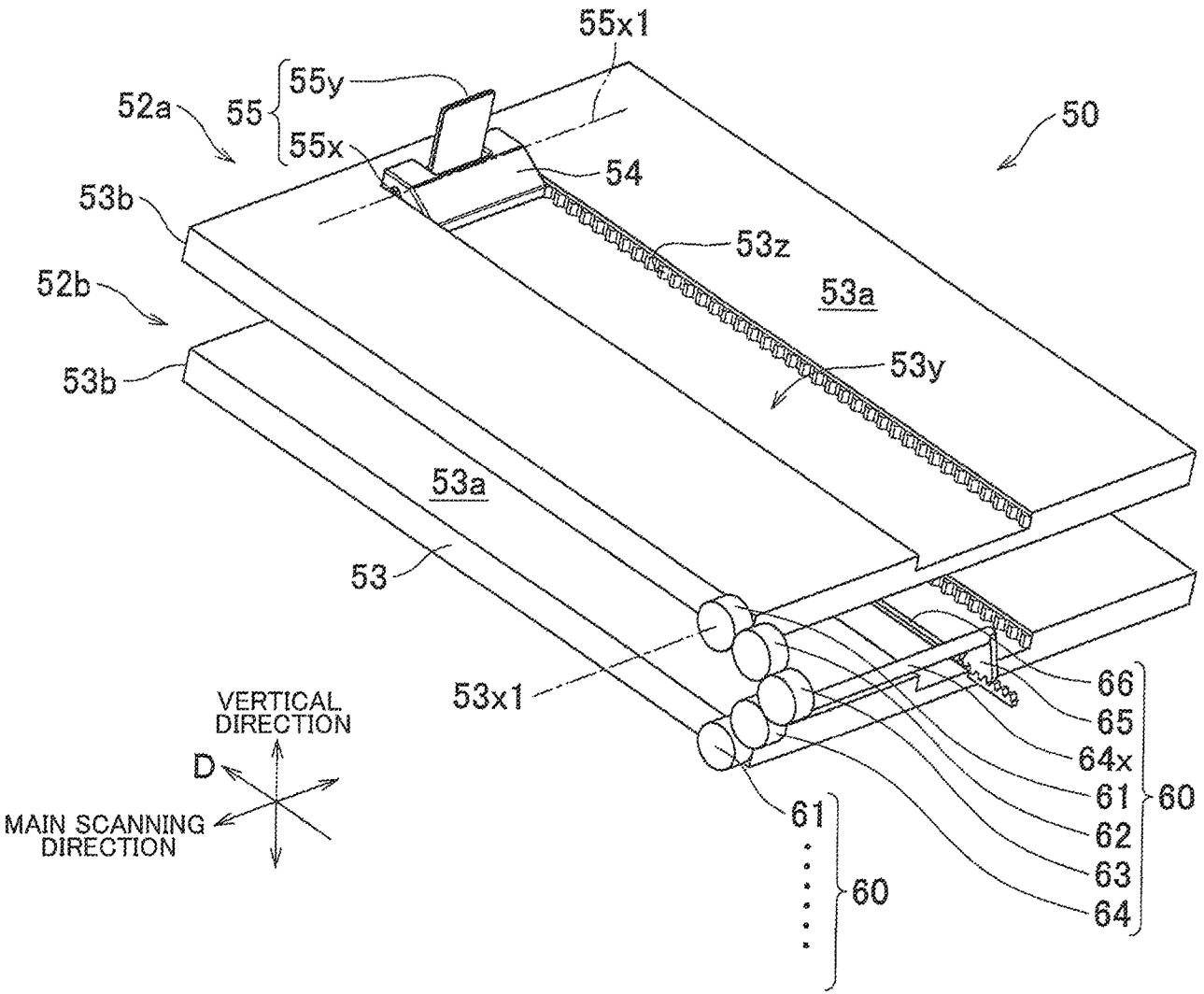
FIG. 4 is a perspective view of two receiving trays and a force transmitting mechanism provided in a tray unit of the ink-jet printer according to the first embodiment, the two receiving trays being an uppermost tray and a second receiving tray from the top.
Figure 5:
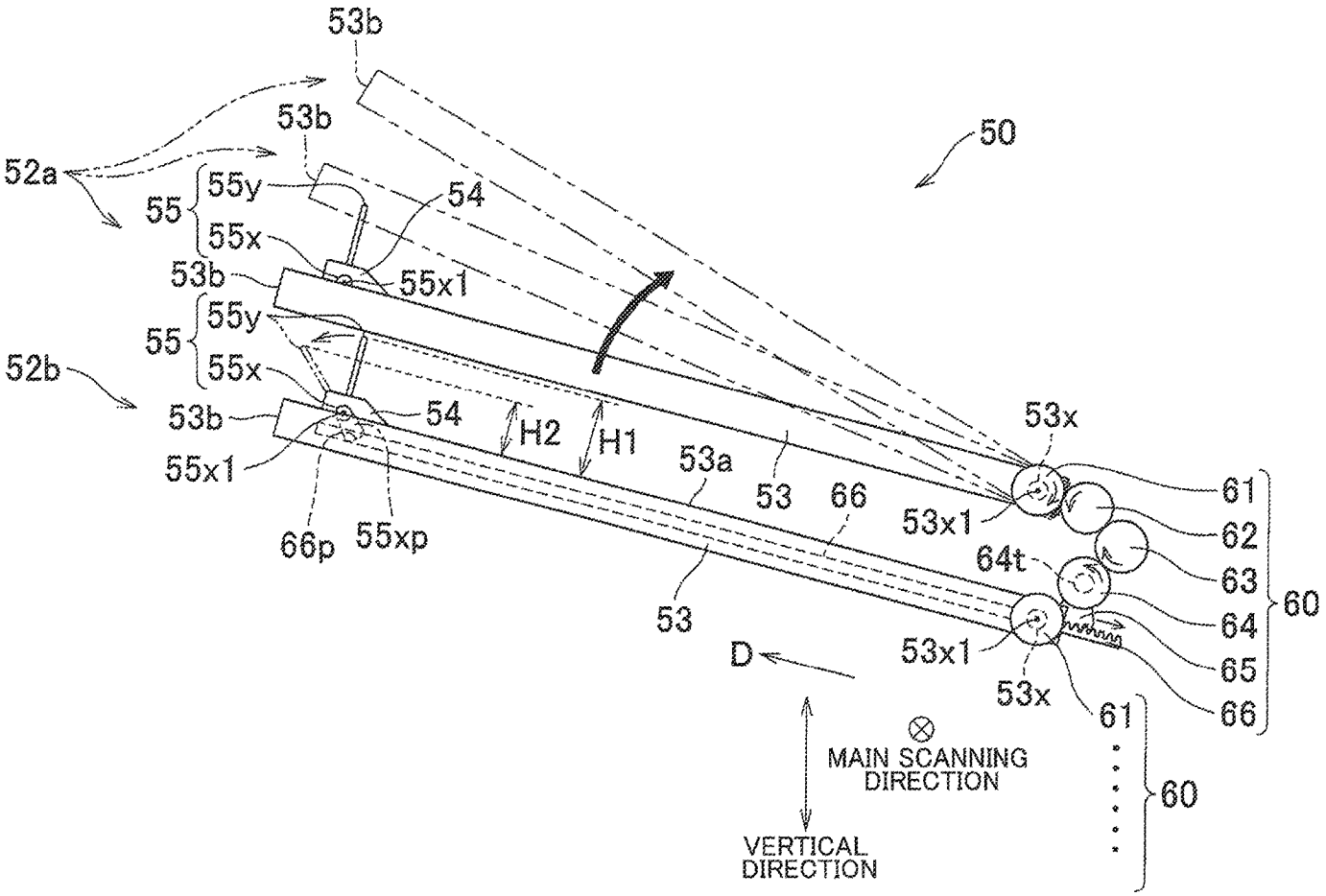
FIG. 5 is a side view of the two receiving trays and the force transmitting mechanism shown in FIG. 4.

Referring next to FIGS. 4 and 5, there will be explained positions at which each of the receiving trays 52*a*-52*d* can be positioned by pivoting with respect to the support 51 and positions at which the stopper 55 of each of the receiving trays 52*a*-52*d* can be positioned by pivoting with respect to the base 54.

Each of the receiving trays 52*a*-52*d* is configured to pivot with respect to the support 51 so as to be selectively positioned at one of: a receiving position (i.e., a position of each of the receiving trays 52*a*, 52*b* indicated by the solid line in FIG. 5) at which each receiving tray 52*a*-52*d* receives the sheet P conveyed by the conveyance mechanism 30; and upper positions (i.e., positions of the receiving tray 52*a* indicated by the respective long dashed double-short dashed lines in FIG. 5) at each of which a height level of a downstream end 53*b* of the tray body 53 in the conveyance direction D is higher than that when each receiving tray 52*a*-52*d* is positioned at the receiving position. When each receiving tray 52*a*-52*d* is positioned at the receiving position, the receiving surface 53*a* is inclined such that a height level of the receiving surface 53*a* gradually increases toward the downstream side in the conveyance direction D. Each receiving tray 52*a*-52*d* is configured to be selectively positioned at one of: a first upper position as the upper position (i.e., a position of the receiving tray 52*a* located second from the top in FIG. 5 and indicated by the long dashed double-short dashed line); and a second upper position as the upper position (i.e., a position of the receiving tray 52*a* located at the top in FIG. 5 and indicated by the long dashed double-short dashed line) at which the height level of the downstream end 53*b* is higher than that when each tray 52*a*-52*d* is positioned at the first upper position. Each receiving tray 52*a*-52*d* is configured to move from the receiving position to the second upper position via the first upper position.

The stopper 55 includes a cylindrical shaft 55*x* having an axis 55*x*1 extending in the main scanning direction and a stopper body 55*y* fixed to the shaft 55*x* and shaped like a flat plate. The stopper body 55*y* extends from the shaft 55*x* in a direction orthogonal to the main scanning direction.

The base 54 includes a bearing (not shown) for supporting the shaft 55*x*. The bearing has an arcuate surface for supporting the circumferential surface of the shaft 55*x*.

The stopper 55 is configured to pivot with respect to the base 54 so as to be selectively positions at one of: a protruding position (indicated by the solid line in FIG. 5) at which the stopper 55 protrudes from the receiving surface 53*a*; and a retracted position (indicated by the long dashed double-short dashed line in FIG. 5) at which a protrusion amount H2 of the stopper 55 from the receiving surface 53*a* is smaller than a protrusion amount H1 thereof from the receiving surface 53*a* when the stopper 55 is positioned at the protruding position. The stopper 55 is urged by a spring (not shown) in a direction from the retracted position toward the protruding position. In a state in which no external force other than the urging force of the spring is applied to the stopper 55, the stopper 55 is kept positioned at the protruding position. When the stopper 55 is positioned at the protruding position, the stopper 55 faces an end of the sheet P in the conveyance direction D received by the receiving surface 53*a*. An angle formed between an upstream-side surface of the stopper body 55*y* in the conveyance direction D and the receiving surface 53*a* is larger when the stopper 55 is positioned at the retracted position than when positioned at the protruding position.

The printer 1 includes a force transmitting mechanism 60 for effectuating: a retracting movement of the stopper 55 of one of lower trays (i.e., the receiving trays 52*b*-52*d*) from the protruding position to the retracted position caused by an upward movement of an adjacent upper tray, which is disposed just above and immediately adjacent to the one of the lower trays, from the receiving position to the upper position; and the upward movement caused by the retracting movement. The force transmitting mechanism 60 is for further effectuating: a first return movement of the stopper 55 of the one of the lower trays from the retracted position to the protruding position caused by a second return movement of the adjacent upper tray from the upper position to the receiving position; and the second return movement caused by the first return movement.

When focusing on one lower tray (i.e., one of the receiving trays 52*b*-52*d*), the force transmitting mechanism 60 includes: gears 61-64 connected to a shaft 53*x* of one adjacent upper tray which is disposed just above and immediately adjacent to the one lower tray; a pinion gear 65 connected to the gear 64 via a shaft 64*x*; and a rack 66 meshing with the pinion gear 65 and provided on the one lower tray. The gear 64 is provided with a torque limiter 64*t*.

The gear 61 is fixed to the shaft 53*x* of the adjacent upper tray and rotates together with the shaft 53*x*. The gear 62 is in mesh with the gear 61, the gear 63 is in mesh with the gear 62, and the gear 64 is in mesh with the gear 63. The gear 64 connected to the shaft 53*x* of the adjacent upper tray and the gear 61 connected to the shaft 53*x* of the one lower tray are spaced apart from each other. The shaft 64*x* is fixed at one end thereof to a rotation center of the gear 64 and at another end thereof to a rotation center of the pinion gear 65.

In the tray body 53 of the lower tray, a groove-like track extending in the conveyance direction D is formed at a central portion, in the main scanning direction, of the bottom surface of the groove 53*y*.

The rack 66 extends within the track in the conveyance direction D. The rack 66 is held in contact with the stopper 55 irrespective of the position of the stopper 55 with respect to the tray body 53. The shaft 55*x* of the stopper 55A has a protruding portion 55*xp* formed at its central portion in the main scanning direction. The protruding portion 55*xp* is held in engagement with a recessed portion 66*p* of the rack 66. The position of the stopper 55 is determined by engagement of the protruding portion 55*xp* and the recessed portion 66*p*.

Referring next to FIG. 5, there will be explained operations of the force transmitting mechanism 60 taking the receiving tray 52*a* as an example of the adjacent upper tray and the receiving tray 52*b* as an example of the one lower tray.

There will be first explained the operation of the force transmitting mechanism 60 for effectuating the upward movement of the receiving tray 52*a* from the receiving position to the upper position caused by the retracting movement of the stopper 55 of the receiving tray 52*b* from the protruding position to the retracted position.

When the stopper 55 of the receiving tray 52*b* is manually moved by a user from the protruding position to the retracted position and pivots counterclockwise in FIG. 5 in a state in which the protruding portion 55*xp* of the stopper 55 and the recessed portion 66*p* of the rack 66 are held in engagement with each other, the rack 66 moves upstream in the conveyance direction D, so that the pinion gear 65 meshing with the rack 66 rotates counterclockwise in FIG. 5 and the gear 64 connected to the pinion gear 65 rotates. The rotation of the gear 64 is transmitted to the gears 61-63. In this instance, the gear 61 rotates clockwise in FIG. 5 together with the shaft 53*x* of the receiving tray 52*a*, so that the receiving tray 52*a* moves from the receiving position to the upper position.

Next, there will be explained the operation of the force transmitting mechanism 60 for effectuating the retracting movement of the stopper 55 of the receiving tray 52*b* from the protruding position to the retracted position caused by the upward movement of the receiving tray 52*a* from the receiving position to the upper position.

When the receiving tray 52*a* is manually moved by the user from the receiving position to the upper position, the gear 61 rotates clockwise in FIG. 5 together with the shaft

53*x* of the receiving tray 52*a*. The rotation of the gear 61 is transmitted to the gears 62-64, so that the pinion gear 65 connected to the gear 64 rotates and the rack 66 provided on the receiving tray 52*b* moves upstream in the conveyance direction D. In a state in which the protruding portion 55*xp* of the stopper 55 of the receiving tray 52*b* is held in engagement with the recessed portion 66*p* of the rack 66, the movement of the rack 66 to the upstream side in the conveyance direction D causes the stopper 55 to pivot counterclockwise in FIG. 5, so that the stopper 55 moves from the protruding position to the retracted position.

In the process of a movement of the adjacent upper tray from the receiving position (i.e., a position of the receiving tray 52*a* indicated by the solid line in FIG. 5) to the second upper position (i.e., a position of the receiving tray 52*a* located at the top in FIG. 5 and indicated by the long dashed double-short dashed line) via the first upper position (i.e., a position of the receiving tray 52*a* located second from the top in FIG. 5 and indicated by the long dashed double-short dashed line), the rotations of the gears 61-65 cause the movement of the rack 66 and the stopper 55 of the one lower tray gradually moves from the protruding position to the retracted position when the adjacent upper tray moves from the receiving position to the first upper position. Subsequently when the adjacent upper tray moves from the first upper position to the second upper position, the torque limiter 64*t* prohibits power transmission among the gears 61-65, so that the rack 66 does not move and the stopper 55 of the lower tray is accordingly kept positioned at the retracted position.

Next, there will be explained the operation of the force transmitting mechanism 60 for effectuating: a movement (second return movement) of the receiving tray 52*a* from the upper position to the receiving position caused by a movement (first return movement) of the stopper 55 of the receiving tray 52*b* from the retracted position to the protruding position.

When the stopper 55 of the receiving tray 52*b* is manually moved by the user from the retracted position to the protruding position and pivots clockwise in FIG. 5 in the state in which the protruding portion 55*xp* of the stopper 55 and the recessed portion 66*p* of the rack 66 are held in engagement with each other, the rack 66 moves downstream in the conveyance direction D, so that the pinion gear 65 engaging with the rack 66 rotates clockwise in FIG. 5 and the gear 64 coupled to the pinion gear 65 rotates. The rotation of the gear 64 is transmitted to the gears 61-63. In this instance, the gear 61 rotates counterclockwise in FIG. 5 together with the shaft 53*x* of the receiving tray 52*a*, so that the receiving tray 52*a* moves from the upper position to the receiving position.

Next, there will be explained the operation of the force transmitting mechanism 60 for effectuating the movement (the first return movement) of the stopper 55 of the receiving tray 52*b* from the retracted position to the protruding position caused by the movement (the second return movement) of the receiving tray 52*a* from the upper position to the receiving position.

When the receiving tray 52*a* is manually moved by the user from the upper position to the receiving position, the gear 61 rotates counterclockwise in FIG. 5 together with the shaft 53*x* of the receiving tray 52*a*. The rotation of the gear 61 is transmitted to the gears 62-64, so that the pinion gear 65 coupled to the gear 64 rotates and the rack 66 provided on the receiving tray 52*b* moves downstream in the conveyance direction D. In the state in which the protruding portion 55*xp* of the stopper 55 of the receiving tray 52*b* and the recessed portion 66*p* of the rack 66 are held in engagement with each other, the downstream movement of the rack 66 in the conveyance direction D causes the stopper 55 to pivot clockwise in FIG. 5, so that the stopper 55 moves from the retracted position to the protruding position.

According to the present embodiment, when the sheet P is taken out of or removed from the lower tray (i.e., one of the receiving trays 52*b*-52*d*), the adjacent upper tray, which is disposed just above and immediately adjacent to the lower tray, moves from the receiving position to the upper position (the upward movement), whereby a work space is enlarged. Further, owing to the force transmitting mechanism 60, it is not necessary to separately or individually perform the movement (the retracting movement) for moving the stopper 55 of the lower tray from the protruding position to the retracted position and the movement (the upward movement) for moving the adjacent upper tray from the receiving position to the upper position. Consequently, the present embodiment facilitates removal of the sheet P from the lower tray. In this sense, the stopper 55 of the lower tray and the adjacent upper tray work in an interlocked fashion.

In the present embodiment, the force transmitting mechanism 60 is configured to further effectuate: the movement (the first return movement) of the stopper 55 of the lower tray from the retracted position to the protruding position caused by the movement (the second return movement) of the adjacent upper tray from the upper position to the receiving position; and the second movement caused by the first return movement. This arrangement eliminates a necessity of separately or individually performing the movement (the first return movement) for moving the stopper 55 of the lower tray from the retracted position to the protruding position and the movement (the second return movement) for moving the adjacent upper tray from the upper position to the receiving position, after the sheet P has been taken out of the lower tray. It is consequently possible to easily return the stopper 55 of the lower tray and the adjacent upper tray to the respective original positions after the sheet P has been taken out of the lower tray.

In the present embodiment, when the stopper 55 is positioned at the protruding position, the stopper 55 faces one end of the sheet P in the conveyance direction D received by the receiving surface 53*a*. This arrangement enables the sheets P conveyed at a high speed to be neatly stacked on the corresponding one of the receiving trays 52*a*-52*d*.

In the present embodiment, there is provided, for the lower trays, a hindering member (the support 51) configured to hinder removal of the sheet P from the receiving surface 53*a* in the main scanning direction. The hindering member makes it difficult to remove, in the main scanning direction, the sheet P received by each lower tray. Therefore, the sheet P is removed from each lower tray in the conveyance direction D. In this instance, the stopper 55 may become an obstacle to the removal of the sheet P in the conveyance direction D. In the present embodiment, however, the force transmitting mechanism 60 effectuates that the retracting movement of the stopper 55 of the lower tray from protruding position to the retracted position and the upward movement of the adjacent upper tray from the receiving position to the upper position are performed in conjunction with each other, thereby facilitating the removal of the sheet P in the conveyance direction D. It is noted that the support 51 functioning as the hindering member may be configured not to hinder the removal of the sheet P from the uppermost receiving tray 52 in the conveyance direction D.

In the present embodiment, the position of the stopper 55 in the conveyance direction D with respect to the tray body 53 is changeable. In this arrangement, the position of the stopper 55 with respect to the tray body 53 is changed in accordance with a dimension of the sheet P in the conveyance direction D, whereby the sheets P having various dimensions in the conveyance direction D can be neatly stacked on the corresponding one of the receiving trays 52*a*-52*d*.

In the present embodiment, the force transmitting mechanism 60 includes the rack 66 (as one example of an extending member) extending in the conveyance direction D so as to be held in contact with the stopper 55 irrespective of the position of the stopper 55 with respect to the tray body 53. In the arrangement in which the position of the stopper 55 in the conveyance direction D with respect to the tray body 53 is changeable, if constituent components such as the gears of the force transmitting mechanism 60 are disposed for each of positions at which the stopper 55 can be located with respect to the tray body 53, the number of the constituent components inevitably increases. In contrast, the present arrangement can reduce the number of constituent components of the force transmitting mechanism 60.

In the present embodiment, each of the receiving trays 52*a*-52*d* is supported by the support 51 so as to be pivotable about the axis 53*x*1 (as one example of a first axis) extending in the main scanning direction. This arrangement enables the movement of each of the receiving trays 52*a*-52*d* between the receiving position and the upper position by a simple mechanism, as compared with an arrangement in which the receiving trays 52*a*-52*d* slide in the vertical direction. It is noted that the lowermost tray 52*d* may be supported by the support 51 so as not to be pivotable about the axis 53*x*1. In other words, at least the receiving trays 52*a*-52*c* other than the lowermost tray 52*d* are supported by the support 51 so as to be pivotable about the axis 53*x*1.

In the present embodiment, the stopper 55 is supported by the tray body 53 so as to be pivotable about the axis 55*x*1 (as one example of a second axis) extending in the main scanning direction. This arrangement enables the movement of the stopper 55 between the protruding position and the retracted position by a simple mechanism, as compared with an arrangement in which the stopper 55 slides in the vertical direction.

In the present embodiment, the force transmitting mechanism 60 includes a torque limiter 64*t* as one example of a transmission prohibiting member. The torque limiter 64*t* is configured: such that, when the adjacent upper tray moves from the receiving position to the first upper position, the torque limiter 64*t* does not prohibit power transmission among the gears 61-65 so as to enable the stopper 55 of the lower tray to move from the protruding position to the retracted position; and such that, when the adjacent upper tray moves from the first upper position to the second upper position, the torque limiter 64*t* prohibits power transmission among the gears 61-65 so as to enable the stopper 55 to be kept at the retracted position without being moved. In this arrangement, when the adjacent upper tray moves from the receiving position to the first upper position, namely, before the adjacent upper tray moves to the second upper position, the stopper 55 of the lower tray moves from the protruding position to the retracted position, so that the stopper 55 can be quickly moved to the retracted position. Further, when the adjacent upper tray moves from the first upper position to the second upper position, the stopper 55 is prevented from further moving from the retracted position. It is thus possible to prevent the force transmitting mechanism 60 from failing to operate due to otherwise caused further movement of the stopper 55. It is noted that the lowermost tray 52*d* may be configured not to be selectively positioned at one of the first upper position and the second upper position. In other words, at least the receiving trays 52*a*-52*c* other than the lowermost tray 52*d* are configured to be electively positioned at one of the first upper position and the second upper position.

Referring next to FIGS. 6 and 7, there will be explained a second embodiment. A printer according to the second embodiment is identical to the printer according to the first embodiment except the number of the receiving trays provided in the tray unit and the structure of the force transmitting mechanism.

A tray unit 250 of the second embodiment includes two receiving trays 52*a*, 52*b*.

A force transmitting mechanism 260 of the second embodiment includes: a cam 261 supported by the support 51 through a spring 261*s*; an L-Shaped plate 262 fixed to the shafts 53*x* of the respective receiving trays 52*a*, 52*b*; a first link 263 whose one end is held in contact with the cam 261; a second link 264 connected to the other end of the first link 263; a pinion gear 265 meshing with one side surface of the second link 264 that is opposite to the other side surface to which the first link 263 is connected; and a rack 266 meshing with the pinion gear 265 and disposed such that the pinion gear 265 is interposed between the rack 266 and the second link 264 in the main scanning direction. The first link 263, the second link 264, the pinion gear 265, and the rack 266 are provided for the receiving tray 52*b*.

The spring 261*s* is connected, at one end thereof, to an upper end of the cam 261 and is connected, at the other end thereof, to an upper wall of the support 51. The spring 261*s* urges the cam 261 upward. The other end of the first link 263 is supported by the other sided surface of the second link 264 so as to be pivotable about an axis extending in the main scanning direction. The second link 264 is provided in the tray body 53 of the receiving tray 52*b* and is movable in the conveyance direction D with respect to the tray body 53 of the receiving tray 52*b*.

Like the rack 66 in the first embodiment, the rack 266 extends in the conveyance direction D within a groove-like track formed in the tray body 53. The rack 266 is held in contact with the stopper 55 irrespective of the position of the stopper 55 with respect to the tray body 53. As in the first embodiment, the shaft 55*x* of the stopper 55 has the protruding portion 55*xp* formed at its central portion in the main scanning direction. The protruding portion 55*xp* is held in engagement with a recessed portion 266*p* of the rack 266. The position of the stopper 55 is determined by engagement of the protruding portion 55*xp* and the recessed portion 266*p*.

Figure 6A:
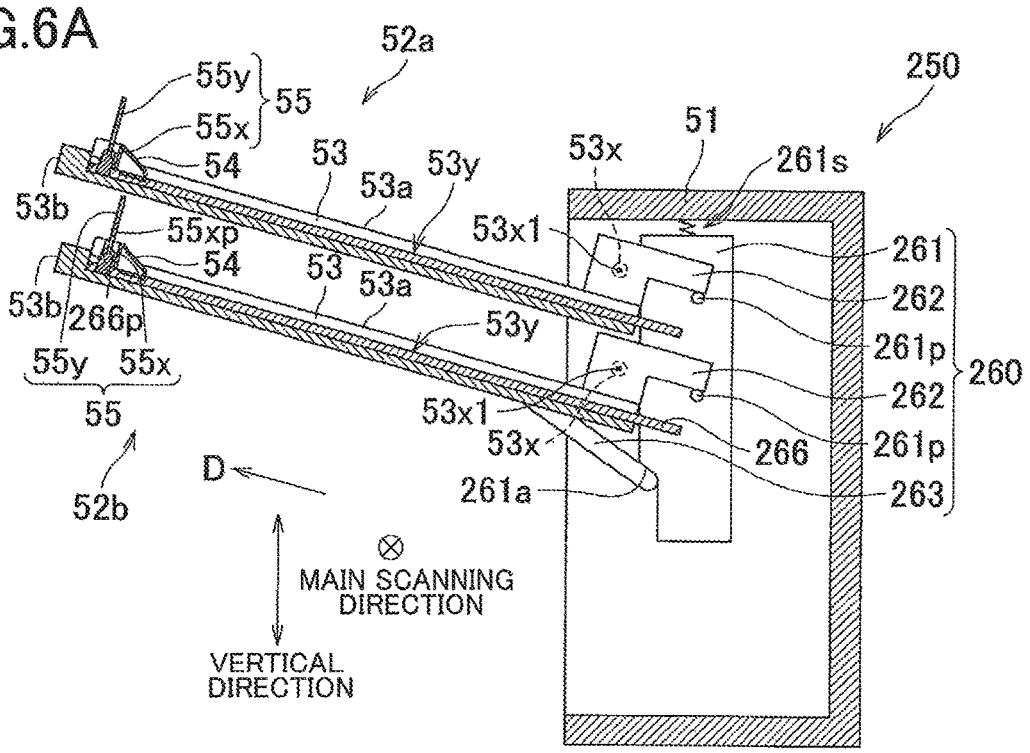
FIGS. 6A and 6B are cross-sectional views schematically showing two receiving trays and a force transmitting mechanism provided in a tray unit of an ink-jet printer according to a second embodiment, FIG. 6A showing a state in which each receiving tray is positioned at a receiving position and a stopper of each receiving tray is positioned at a protruding position, FIG. 6B showing a state in which an upper tray is positioned at an upper position and the stopper of a lower tray is positioned at a retracted position.

When each of the receiving trays 52*a*, 52*b* is positioned at the receiving position, the L-shaped plates 262 of the respective receiving trays 52*a*, 52*b* are in contact with respective protruding pins 261*p* of the cam 261, as shown in FIG. 6A. Each pin 261*p* protrudes from a surface of the cam 261 in the main scanning direction. In this state, the one end of the first link 263 is in contact with an inclined surface 261*a* of the cam 261.

There will be explained operations of the force transmitting mechanism 260.

The force transmitting mechanism 260 effectuates: the retracting movement caused by the upward movement; and the first return movement caused by the second return movement. The transmitting mechanism 260 does not effectuate the upward movement caused by the retracting movement; and the second return movement caused by the first return movement.

There will be first explained the operation of the force transmitting mechanism 260 for effectuating the movement (the retracting movement) of the stopper 55 of the receiving tray 52*b* from the protruding position to the retracted position caused by the movement (the upward movement) of the receiving tray 52*a* from the receiving position to the upper position.

Figure 6B:
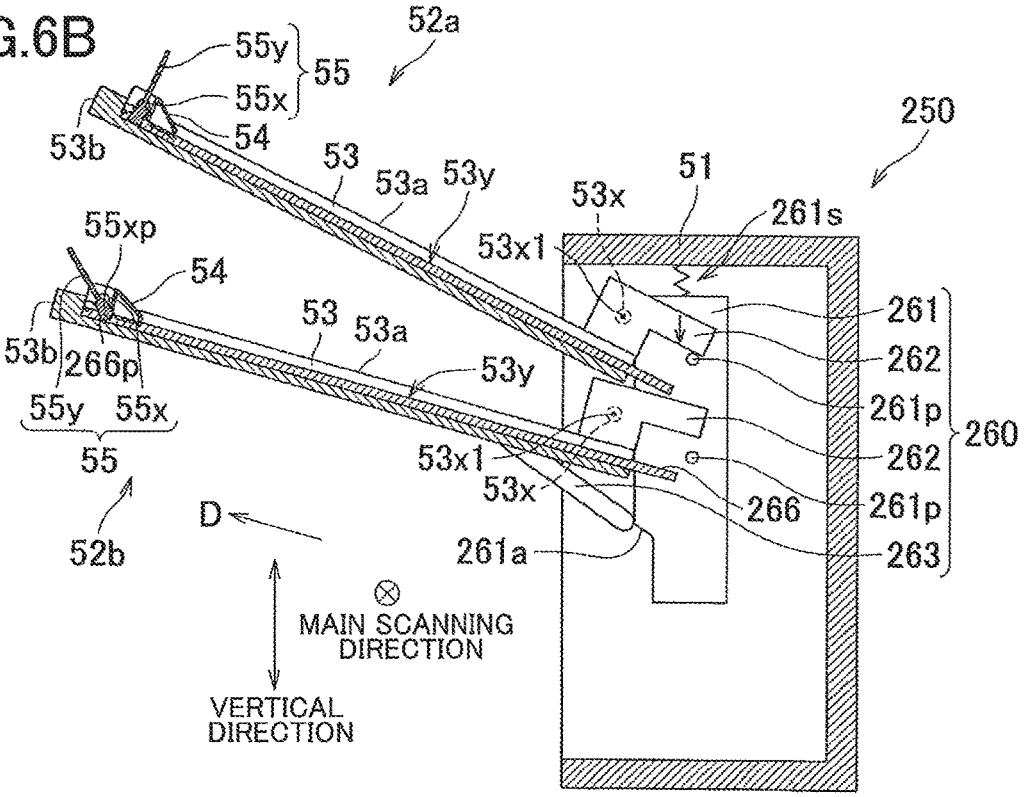
Figure 7A:
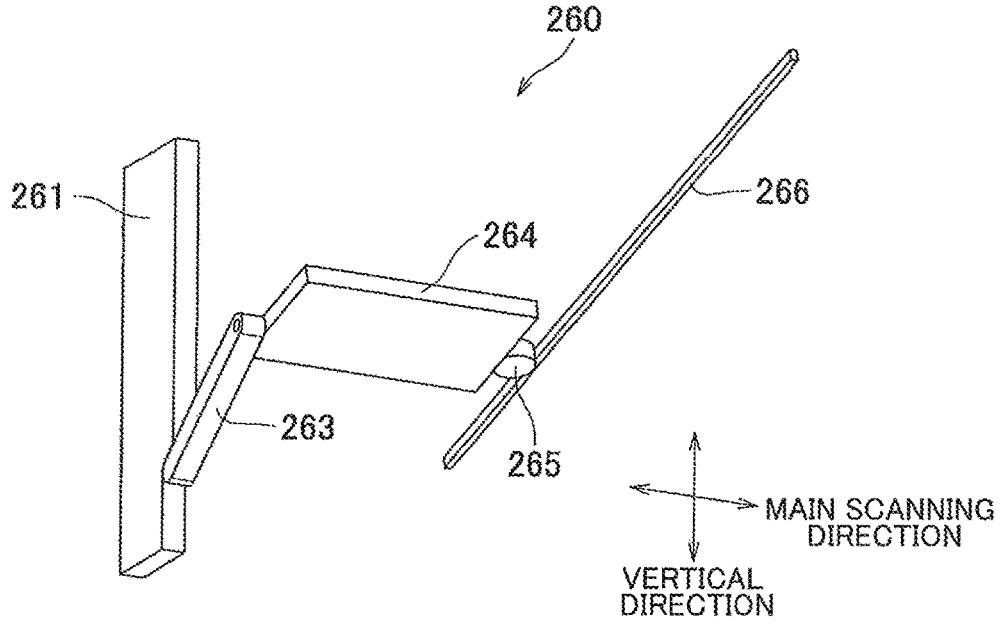
FIGS. 7A and 7B are perspective views of the force transmitting mechanism according to the second embodiment, FIG. 7A showing a state corresponding to FIG. 6A, FIG. 7B showing a state corresponding to FIG. 6B.
Figure 7B:
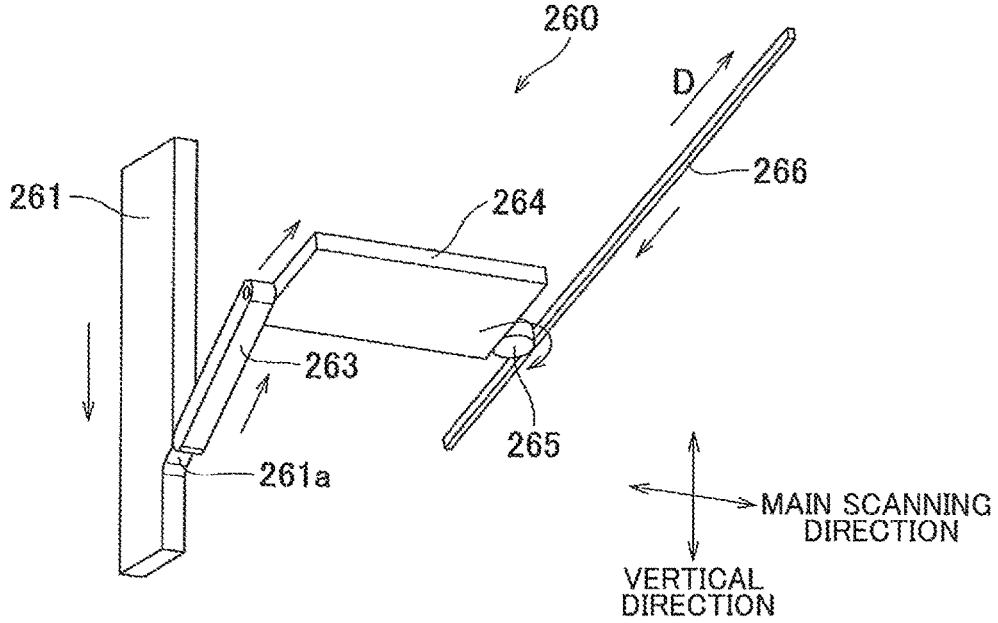

When the receiving tray 52*a* is manually moved by the user form the receiving position to the upper position, the L-shaped plate 262 of the receiving tray 52*a* pushes down the pin 261*p*, and the cam 261 moves downward against the urging force of the spring 261*s*, as shown in FIGS. 6A and 6B. Subsequently, the one end of the first link 263 moves obliquely upward along the inclined surface 261*a*, and the second link 264 connected to the first link 263 moves downstream in the conveyance direction D with respect to the tray body 53 of the receiving tray 52*b*, as shown in FIGS. 7A and 7B. The movement of the second link 264 to the downstream side causes the pinion gear 265 to rotate, so that the rack 266 moves upstream in the conveyance direction D. In a state in which the protruding portion 55*xp* of the stopper 55 provided on the receiving tray 52*b* and the recessed portion 266*p* of the rack 266 are held in engagement with each other, the movement of the rack 266 to the upstream side in the conveyance direction D causes the stopper 55 to pivot counterclockwise in FIG. 6, so that the stopper 55 moves from the protruding position to the retracted position.

There will be next explained the operation of the force transmitting mechanism 260 for effectuating the movement (the first return movement) of the stopper 55 of the receiving tray 52*b* from the retracted position to the protruding position caused by the movement (the second return movement) of the receiving tray 52*a* from the upper position to the receiving position.

When the receiving tray 52*a* is manually moved by the user from the upper position to the receiving position, the pin 261*p* is released from the pushing by the L-shaped plate 262 of the receiving tray 52*a*, and the cam 261 moves upward by the urging force of the spring 261*s*, as shown in FIGS. 6B and 6A. Subsequently, the one end of the first link 263 moves obliquely downward along the inclined surface 261*a*, and the second link 264 connected to the first link 263 moves upstream in the conveyance direction D, namely, moves in a direction opposite to the direction indicated by an arrow in FIG. 7B, with respect to the tray body 53 of the receiving tray 52*b*. The movement of the second link 264 to the upstream side causes the pinion gear 265 to rotate, so that the rack 266 moves downstream in the conveyance direction D. In the state in which the protruding portion 55*xp* of the stopper 55 provided on the receiving tray 52*b* and the recessed portion 266*p* of the rack 266 are held in mesh with each other, the movement of the rack 266 to the downstream side in the conveyance direction D causes the stopper 55 to pivot clockwise in FIG. 6, so that the stopper 55 moves from the retracted position to the protruding position.

As described above with respect to the first embodiment, when the sheet P is taken out of or removed from the lower tray (the receiving tray 52*b*), the adjacent upper tray (the receiving tray 52*a*), which is disposed just above and immediately adjacent to the lower tray, moves from the receiving position to the upper position (the upward movement), whereby a work space is enlarged. Further, owing to the force transmitting mechanism 260, it is not necessary to separately or individually perform the movement (the retracting movement) for moving the stopper 55 of the lower tray from the protruding position to the retracted position and the movement (the upward movement) for moving the adjacent upper tray from the receiving position to the upper position. Consequently, the present embodiment facilitates removal of the sheet P from the lower tray. In this sense, the stopper 55 of the lower tray and the adjacent upper tray work in an interlocked fashion.

In addition, the second embodiment offers advantages similar to those in the first embodiment owing to the configuration similar to that in the first embodiment.

Figure 8:
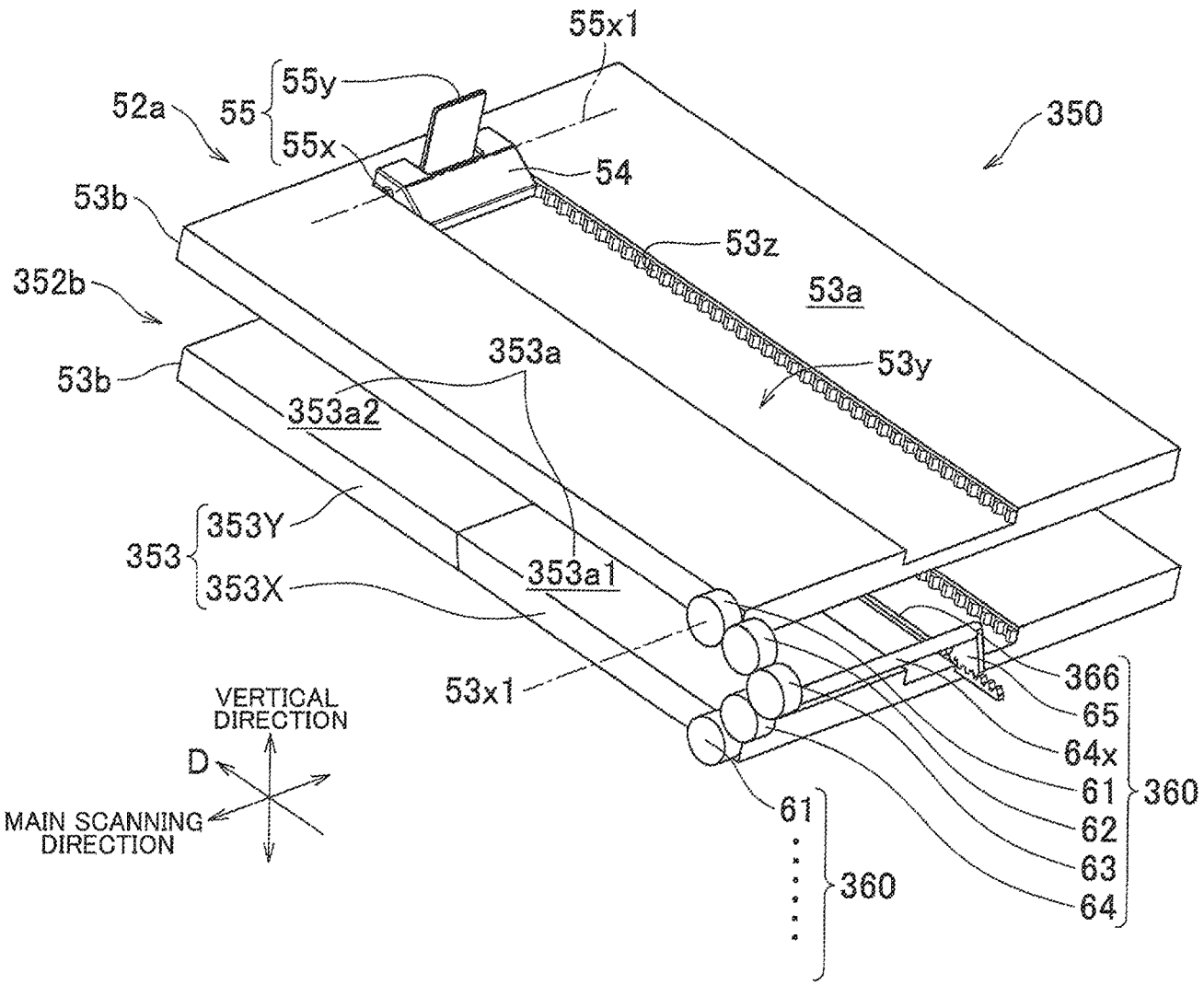
FIG. 8 is a perspective view of two receiving trays and a force transmitting mechanism provided in a tray unit of an ink-jet printer according to a third embodiment.
Figure 9:
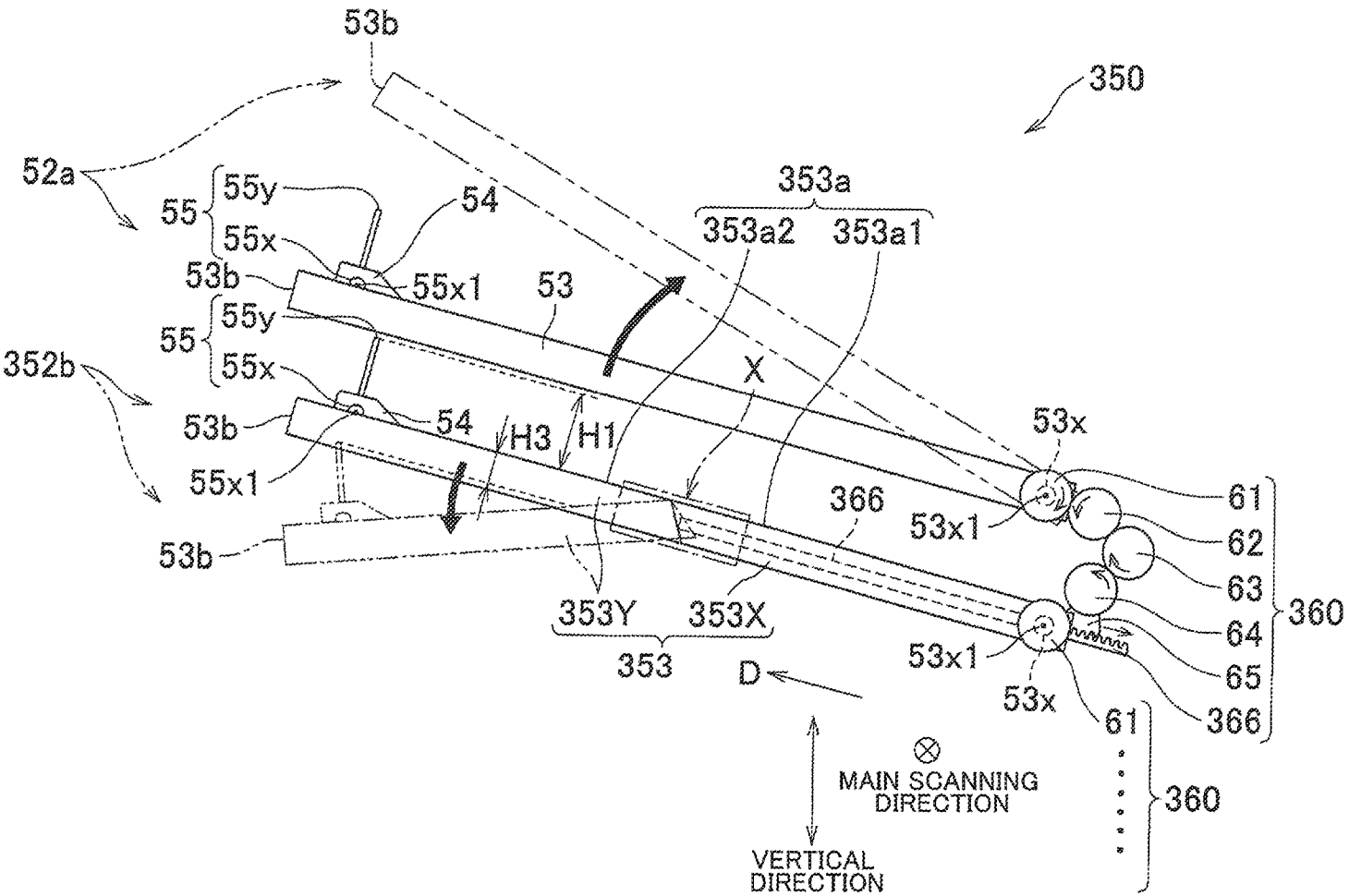
FIG. 9 is a side view of the two receiving trays and the force transmitting mechanism shown in FIG. 8.

Referring next to FIGS. 8-10, there will be explained a third embodiment. A printer according to the third embodiment is identical to the printer according to the first embodiment except the number of the receiving trays provided in the tray unit, the structure of the lower tray, and the structure of the force transmitting mechanism.

A tray unit 350 of the third embodiment includes two receiving trays 52*a*, 352*b*.

The receiving tray 352*b* functioning as the lower tray includes: a tray body 353 shaped like a plate and having the groove 53*y* formed in its upper surface; the base 54; and the stopper 55. The tray body 353 has a receiving surface 353*a* for receiving the sheet P.

The tray body 353 includes a proximal portion 353X which defines a part 353*a*1 of the receiving surface 353*a* and a distal portion 353Y which is located downstream of the proximal portion 353X in the conveyance direction D and which defines the rest 353*a*2 of the receiving surface 353*a*. The base 54 and the stopper 55 are provided for the distal portion 353Y. The stopper 55 protrudes from the rest 353*a*2 of the receiving surface 353*a*.

The distal portion 353Y is pivotally attached to the proximal portion 353X about an axis extending in the main scanning direction, so as to be selectively positioned at one of a first position indicated by the solid line in FIG. 9 and a second position indicated by the long dashed double-short dashed line in FIG. 9. A protrusion amount H3 of the stopper 55 from a plane along the part 353*a*1 of the receiving surface 353*a* of the proximal portion 353X when the distal portion 353Y is positioned at the second position is a negative value in the present embodiment, and the protrusion amount H3 is smaller than a protrusion amount H1 of the stopper 55 when the distal portion 353Y is positioned at the first position.

The sheet P received by the receiving tray 352*b* is supported by both of the proximal portion 353X and the distal portion 353Y or by only the proximal portion 353X, depending upon the dimension of the sheet P in the conveyance direction D. In an instance where the sheet P is supported by both of the proximal portion 353X and the distal portion 353Y when the distal portion 353Y is positioned at the first position, a downstream portion of the sheet P in the conveyance direction D may be kept supported by the receiving surface 353*a*2 or may be apart from the receiving surface 353*a*2 when the distal portion 353Y moves from the first position to the second position.

A force transmitting mechanism 360 of the third embodiment is identical to the force transmitting mechanism 60 of the first embodiment except the structure of a rack.

Figure 10A:
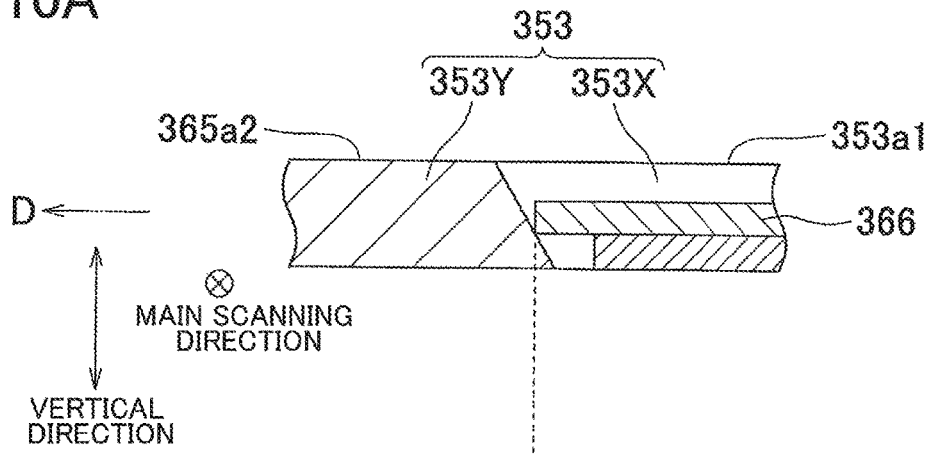
FIGS. 10A and 10B are cross-sectional views of a portion X in FIG. 9, FIG. 10A showing a state in which a distal portion of a lower tray is positioned at a first position, FIG. 10B showing a state in which the distal portion is positioned at the second position.
Figure 10B:
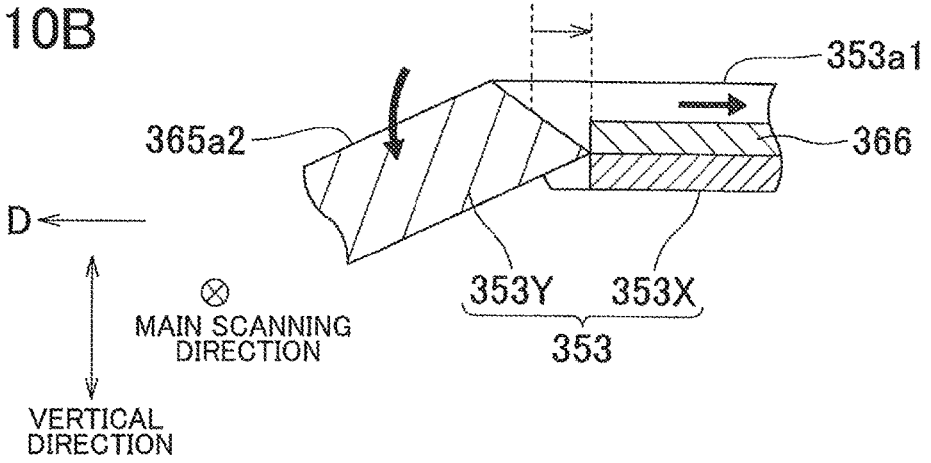

Like the rack 66 of the first embodiment, a rack 366 of the third embodiment is in mesh with the pinion gear 65 and is provided for the lower tray. In contrast to the rack 66 of the first embodiment that extends substantially throughout the conveyance direction D of the tray body 53, the rack 366 of the third embodiment is provided only for the proximal portion 353X. In the proximal portion 353X, a groove-like track extending in the conveyance direction D is formed at a central portion, in the main scanning direction, of a bottom surface of the groove 53*y*. The rack 366 extends within the track in the conveyance direction D. An upstream end of the rack 366 in the conveyance direction D is held in mesh with the pinion gear 65, and a downstream end of the rack 366 in the conveyance direction D is held in contact with an upstream end surface of the distal portion 353Y in the conveyance direction D, as shown in FIGS. 10A and 10B.

The upstream end surface of the distal portion 353Y in the conveyance direction D is inclined such that a lower portion of the upstream end surface is located on a more upstream side in the conveyance direction D than an upper portion thereof. In other words, the upstream end surface of the distal portion 353Y in the conveyance direction D is inclined such that the dimension of the distal portion 353Y in the vertical direction gradually decreases toward the upstream side in the conveyance direction D. When the distal portion 353Y is positioned at the first position, the downstream end of the rack 366 in the conveyance direction D is held in contact with a substantially vertically central portion of the upstream end surface of the distal portion 353Y in the conveyance direction D, as shown in FIG. 10A.

There will be explained operations of the force transmitting mechanism 360.

The force transmitting mechanism 360 effectuates: a movement of the receiving tray 52*a* from the receiving position to the upper position, i.e., an upward movement, caused by a movement of the distal portion 353Y of the receiving tray 352*b* from the first position to the second position, i.e., a distal-portion movement; and the distal-portion movement caused by the upward movement.

There will be first explained the operation of the force transmitting mechanism 360 for effectuating the movement (the upward movement) of the receiving tray 52*a* from the receiving position to the upper position caused by the movement (the distal-portion movement) of the distal portion 353Y of the receiving tray 352*b* from the first position to the second position.

When the distal portion 353Y of the receiving tray 352*b* is manually moved by the user from the first position to the second position, the upstream end surface of the distal portion 353Y in the conveyance direction D pushes the rack 366, and the rack 366 moves upstream in the conveyance direction D, as shown in FIGS. 10A and 10B. The movement of the rack 366 to the upstream side causes the pinion gear 65 engaging with the rack 366 to rotate counterclockwise in FIG. 9, and the gear 64 connected to the pinion gear 65 rotates. The rotation of the gear 64 is transmitted to the gears 61-63. In this instance, the gear 61 rotates clockwise in FIG. 9 together with the shaft 53*x* of the receiving tray 52*a*, so that the receiving tray 52*a* moves from the receiving position to the upper position.

There will be next explained the operation of the force transmitting mechanism 360 for effectuating the movement (the distal-portion movement) of the distal portion 353Y of the receiving tray 352*b* from the first position to the second position caused by the movement (the upward movement) of the receiving tray 52*a* form the receiving position to the upper position.

When the receiving tray 52*a* is manually moved by the user from the receiving position to the upper position, the gear 61 rotates clockwise in FIG. 9 together with the shaft 53*x* of the receiving tray 52*a*. The rotation of the gear 61 is transmitted to the gears 62-64, and the pinion gear 65 coupled to the gear 64 rotates, whereby the rack 366 provided on the receiving tray 352*b* moves upstream in the conveyance direction D. When the rack 366 moves upstream in the conveyance direction D as shown in FIGS. 10A and 10B, the distal portion 353Y of the receiving tray 352*b* pivots counterclockwise in FIG. 10B by its own weight, so that the distal portion 353Y moves from the first position to the second position.

According to the third embodiment described above, when the sheet P is taken out of or removed from the lower tray (the receiving tray 352*b*), the adjacent upper tray (the receiving tray 52*a*), which is disposed just above and immediately adjacent to the lower tray, moves from the receiving position to the upper position (the upward movement), so that a work space is enlarged. Further, owing to the force transmitting mechanism 360, it is not necessary to separately or individually perform the movement (the distal-portion movement) for moving the distal portion 353Y of the lower tray from the first position to the second position and the movement (the upward movement) for moving the adjacent upper tray from the receiving position to the upper position. Consequently, the present embodiment facilitates removal of the sheet P from the lower tray. In this sense, the stopper 55 of the lower tray and the adjacent upper tray work in an interlocked fashion.

In addition, the third embodiment offers advantages similar to those in the first embodiment owing to the configuration similar to that in the first embodiment.

While the embodiments of the present disclosure have been explained, it is to be understood that the disclosure is not limited to the details of the illustrated embodiments, but may be embodied with other changes and modifications without departing from the scope of the disclosure defined in the attached claims.

Modifications

The lowermost tray may be fixed to the support.

The uppermost tray is not necessarily required to have the protruding portion.

The receiving tray may be configured to be selectively positioned at one of the receiving position and the upper position not by pivoting with respect to the support but by sliding with respect to the support.

The receiving surface of the receiving tray when positioned at the receiving position may extend in the horizontal direction without inclining such that the height level of the receiving surface becomes higher toward the downstream side in the conveyance direction.

The protruding portion may be configured to be selectively positioned at one of the protruding position and the retracted position not by pivoting with respect to the tray body but by sliding with respect to the tray body.

The protruding portion may be configured such that its position in the conveyance direction with respect to the tray body is unchangeable.

The protruding portion may be configured such that, when positioned at the protruding position, the protruding portion faces an end of the medium received by the receiving surface, the end of the medium being in a direction orthogonal to both of the vertical direction and the conveyance direction. In other words, the protruding portion may be the so-called side stopper.

The torque limiter as the force-transmission prohibiting member may be provided for any one of the gears 61-64 of the force transmitting mechanism. While the torque limiter is illustrated as one example of the force-transmission prohibiting member in the first embodiment, the force-transmission prohibiting member may be otherwise embodied. For instance, the force-transmission prohibiting member may be constructed as follows. The surface of the rack 66 is formed by: a first portion formed of rubber or the like and having a large friction coefficient; and a second portion formed of fluorocarbon resin or the like and having a small friction coefficient. The first portion of the thus constructed rack 66 supports the shaft 55*x* of the stopper 55. In this structure, when the adjacent upper tray moves from the receiving position to the first upper position, the shaft 55*x* of the stopper 55 of the lower tray pivots by a frictional force caused between the first portion of the rack 66 and the shaft 55*x* of the stopper 55 as the rack 66 moves, so that the stopper 55 moves from the protruding position to the retracted position. When the adjacent upper tray moves from the first upper position to the second upper position thereafter, the shaft 55*x* of the stopper 55 of the lower tray is located on the second portion of the rack 66. In this state, even if the rack 66 moves, the shaft 55*x* of the stopper 55 does not pivot, and the stopper 55 is kept located at the retracted position.

The force-transmission prohibiting member may be provided for the configurations in the second and third embodiments. It is noted that the force-transmission prohibiting member is not an essential component and may be omitted.

The force transmitting mechanism may include an operational portion through which the user can manually operate the force transmitting mechanism. For instance, any one of the gears 61-64 may include a dial operational portion. Further, the extending member may include an operational portion movable with the extending member.

When the adjacent upper tray moves from the receiving position to the upper position, the lower tray may move from the receiving position to a lower position at which the height level of the downstream end of the lower tray is lower than that when the lower tray is positioned at the receiving position (e.g., a position at which the receiving surface is horizontal, and the protruding portion of the lower tray may move from the protruding position to the retracted position by the movement of the lower tray from the receiving position to the lower position.

The force transmitting mechanism is not necessarily required to effectuate both of: (a) the upward movement caused by the retracting movement or the distal-portion movement; and (b) the retracting movement or the distal-portion movement caused by the upward movement, but may be configured to effectuate at least one of (a) and (b).

The conveyor is not limited to the printer, but may be a facsimile, a copying machine, a multi-function peripheral (MFP) or the like.

The recording portion is not limited to the line type, but may be a serial type. The recording portion is not limited to the ink-jet type, but may be a laser type, a thermal type or the like. The conveyor may be configured not to include the recording portion.

The medium is not limited to the sheet, but may be cloth or the like. The medium may be the one on which an image is not recorded.

What is claimed is:

1. A conveyor, comprising:

a plurality of receiving trays arranged in a vertical direction and each having a receiving surface by which a medium is received;

a conveyance mechanism configured to convey the medium such that medium is selectively received by one of the receiving surfaces of the receiving trays; and a support supporting the receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a tray body that forms the receiving surface and a protruding portion attached to the tray body so as to be selectively positioned at one of a protruding position at which the protruding portion protrudes from the receiving surface and a retracted position at which a protrusion amount of the protruding portion from the receiving surface is smaller than that when the protruding portion is positioned at the protruding position, and wherein the conveyor further comprises a force transmitting mechanism for effectuating at least one of (a) a retracting movement of the protruding portion of one of the at least one lower tray caused by an upward movement of an adjacent upper tray which is disposed just above and immediately adjacent to the one of the at least one lower tray and (b) the upward movement caused by the retracting movement, the retracting movement being a movement in which the protruding portion of the one of the at least one lower tray moves from the protruding position to the retracted position, the upward movement being a movement in which the adjacent upper tray moves from the receiving position to the upper position.

2. The conveyor according to claim 1, wherein the force transmitting mechanism is configured to effectuate at least one of (c) a first return movement of the protruding portion of the one of the at least one lower tray caused by a second return movement of the adjacent upper tray and (d) the second return movement caused by the first return movement, the first return movement being a movement in which the protruding portion of the one of the at least one lower tray moves from the retracted position to the protruding position, the second return movement being a movement in which the adjacent upper tray moves from the upper position to the receiving position.

3. The conveyor according to claim 1, wherein, when the protruding portion is positioned at the protruding position, the protruding portion faces an end of the medium in the conveyance direction received by the receiving surface.

4. The conveyor according to claim 3, wherein a hindering member is provided for the at least one lower tray except the uppermost one of the receiving trays, the hindering member being configured to hinder removal of the medium from the receiving surface in a direction orthogonal to both of the vertical direction and the conveyance direction.

5. The conveyor according to claim 3, wherein a position of the protruding portion in the conveyance direction with respect to the tray body is changeable.

6. The conveyor according to claim 5, wherein the force transmitting mechanism includes an extending member extending in the conveyance direction so as to be held in contact with the protruding portion irrespective of the position of the protruding portion with respect to the tray body.

7. The conveyor according to claim 1, wherein the at least one receiving tray except the lowermost one of the receiving trays is supported by the support so as to be pivotable about a first axis extending in a direction orthogonal to both of the vertical direction and the conveyance direction.

8. The conveyor according to claim 1, wherein the protruding portion is supported by the tray body so as to be pivotable about a second axis extending in a direction orthogonal to both of the vertical direction and the conveyance direction.

9. The conveyor according to claim 1, wherein the at least one receiving tray except the lowermost one of the receiving trays is configured to be selectively positioned at one of a first upper position as the upper position and a second upper position, as the upper position, at which the height level of the downstream end of the medium is higher than that when the at least one receiving tray is positioned at the first upper position, and wherein the force transmitting mechanism includes a force-transmission prohibiting member configured such that, when the adjacent upper tray moves from the receiving position to the first upper position, the force-transmission prohibiting member does not prohibit effectuation of the retracting movement of the protruding portion of the one of the at least one lower tray caused by the upward movement of the adjacent upper tray, so that the protruding portion of the one of the at least one lower tray is moved from the protruding position to the retracted position and such that, when the adjacent upper tray moves from the first upper position to the second upper position, the force-transmission prohibiting member prohibits the effectuation of the retracting movement caused by the upward movement, so that the protruding portion of the one of the at least one lower tray is kept positioned at the retracted position without being moved.

10. The conveyor according to claim 1, wherein at least a part of a projective area formed by projecting, in the vertical direction, the receiving surface of each of the at least one lower tray on an imaginary plane orthogonal to the vertical direction overlaps a projective area formed by projecting, in the vertical direction, the receiving surface of any one of the receiving trays disposed above said each of the at least one lower tray.

11. A conveyor, comprising:

a plurality of receiving trays arranged in a vertical direction and each having a receiving surface by which a medium is received;

a conveyance mechanism configured to convey the medium such that the medium is selectively received by one of the receiving surfaces of the receiving trays; and a support supporting the receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a proximal portion which defines a part of the receiving surface and a distal portion which is located downstream of the proximal portion in the conveyance direction and which defines the rest of the receiving surface, wherein the distal portion includes a protruding portion protruding from the rest of the receiving surface and is pivotally attached to the proximal portion so as to be selectively positioned at one of a first position and a second position at which a protrusion amount of the protruding portion from a plane along the part of the receiving surface of the proximal portion is smaller than that when the distal portion is positioned at the first position, and wherein the conveyor further comprises a force transmitting mechanism for effectuating at least one of (e) a distal-portion movement of the distal portion of one of the at least one lower tray caused by an upward movement of an adjacent upper tray which is disposed just above and immediately adjacent to the one of the at least one lower tray and (f) the upward movement caused by the distal-portion movement, the distal-portion movement being a movement in which the distal portion of the one of the at least one lower tray moves from the first position to the second position, the upward movement being a movement in which the adjacent upper tray moves from the receiving position to the upper position.

12. The conveyor according to claim 11, wherein at least a part of a projective area formed by projecting, in the vertical direction, the receiving surface of each of the at least one lower tray on an imaginary plane orthogonal to the vertical direction overlaps a projective area formed by projecting, in the vertical direction, the receiving surface of any one of the receiving trays disposed above said each of the at least one lower tray.

13. A tray unit for a conveyor, the conveyor comprising: a plurality of receiving trays arranged in a vertical direction and each having a receiving surface by which a medium is received; a conveyance mechanism configured to convey the medium such that medium is selectively received by one of the receiving surfaces of the receiving trays; and a support supporting the receiving trays, the tray unit comprising the plurality of receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a tray body that forms the receiving surface and a protruding portion attached to the tray body so as to be selectively positioned at one of a protruding position at which the protruding portion protrudes from the receiving surface and a retracted position at which a protrusion amount of the protruding portion from the receiving surface is smaller than that when the protruding portion is positioned at the protruding position, and wherein the tray unit further comprises a force transmitting mechanism for effectuating at least one of (a) a retracting movement of the protruding portion of one of the at least one lower tray caused by an upward movement of an adjacent upper tray which is disposed just above and immediately adjacent to the one of the at least one lower tray and (b) the upward movement caused by the retracting movement, the retracting movement being a movement in which the protruding portion of the one of the at least one lower tray moves from the protruding position to the retracted position, the upward movement being a movement in which the adjacent upper tray moves from the receiving position to the upper position.

14. A tray unit for a conveyor, the conveyor comprising: a plurality of receiving trays arranged in a vertical direction and each having a receiving surface by which a medium is received; a conveyance mechanism configured to convey the medium such that the medium is selectively received by one of the receiving surfaces of the receiving trays; and a support supporting the receiving trays, the tray unit comprising the plurality of receiving trays, wherein at least one receiving tray, except a lowermost one of the receiving trays that is disposed at the lowest position, is supported by the support so as to be selectively positioned at one of a receiving position at which the at least one receiving tray receives the medium conveyed by the conveyance mechanism and an upper position at which a height level of a downstream end of the medium in a conveyance direction thereof received by the receiving surface is higher than that when the at least one receiving tray is positioned at the receiving position, wherein at least one lower tray, except an uppermost one of the receiving trays that is disposed at the highest position, includes a proximal portion which defines a part of the receiving surface and a distal portion which is located downstream of the proximal portion in the conveyance direction and which defines the rest of the receiving surface, wherein the distal portion includes a protruding portion protruding from the rest of the receiving surface and is pivotally attached to the proximal portion so as to be selectively positioned at one of a first position and a second position at which a protrusion amount of the protruding portion from a plane along the part of the receiving surface of the proximal portion is smaller than that when the distal portion is positioned at the first position, and wherein the tray unit further comprises a force transmitting mechanism for effectuating at least one of (e) a distal-portion movement of the distal portion of one of the at least one lower tray caused by an upward movement of an adjacent upper tray which is disposed just above and immediately adjacent to the one of the at least one lower tray and (f) the upward movement caused by the distal-portion movement, the distal-portion movement being a movement in which the distal portion of the one of the at least one lower tray moves from the first position to the second position, the upward movement being a movement in which the adjacent upper tray moves from the receiving position to the upper position.

* * * * *